US010912423B2

(12) United States Patent
Williams

(10) Patent No.: US 10,912,423 B2
(45) Date of Patent: Feb. 9, 2021

(54) EXTENDABLE SHOWER SEAT

(71) Applicant: Dorothy F. Williams, Northford, CT (US)

(72) Inventor: Dorothy F. Williams, Northford, CT (US)

( * ) Notice: Subject to any disclaimer, the term of this patent is extended or adjusted under 35 U.S.C. 154(b) by 0 days.

(21) Appl. No.: 16/103,522

(22) Filed: Aug. 14, 2018

(65) Prior Publication Data

US 2020/0229653 A1 Jul. 23, 2020

(51) Int. Cl.
*A47K 3/28* (2006.01)
*A47K 3/12* (2006.01)

(52) U.S. Cl.
CPC ..... *A47K 3/282* (2013.01); *A47K 3/122* (2013.01); *A47K 3/125* (2013.01)

(58) Field of Classification Search
CPC ..... A47K 3/282; A47K 3/122; A47K 3/125; A47C 1/023; A47C 1/00; A61G 7/1003
See application file for complete search history.

(56) References Cited

U.S. PATENT DOCUMENTS 2,725,576 A 12/1955 Carl
4,150,445 A * 4/1979 Bailey ..... A47K 3/122 4/546
4,472,844 A 9/1984 Mace
5,361,428 A 11/1994 Nanowsky et al.
6,773,059 B2 * 8/2004 Volotsenko ..... A47C 13/00 297/129
8,152,233 B2 * 4/2012 Wechter ..... A47K 3/122 108/69
9,107,787 B2 * 8/2015 Wechter ..... A47K 3/122
2008/0148473 A1 * 6/2008 Cheng ..... A61G 7/1059 4/578.1
2010/0038934 A1 * 2/2010 Bennett ..... A47K 3/122 297/16.1
2010/0251475 A1 10/2010 Ferrazzani
2011/0289678 A1 * 12/2011 Huang ..... A61G 7/1003 5/81.1 R
2011/0289679 A1 * 12/2011 Huang ..... A61G 7/1003 5/81.1 RP

* cited by examiner

*Primary Examiner* — Janie M Loeppke
(74) *Attorney, Agent, or Firm* — Boudwin Intellectual Property; Daniel Boudwin

(57) ABSTRACT

An extendable shower seat. The extendable shower seat includes a chair having a back portion and a seat portion, wherein the back portion is perpendicularly affixed to a rear side of the seat portion. A frame is affixed to the lower side of the seat portion and a plurality of legs are affixed to the frame. A pair of sidewalls are each pivotally affixed to opposing lateral sides of the seat portion about a hinge, wherein the pair of sidewalls can pivot about the hinge when a button disposed on the hinge is actuated, and remain locked in the selected position when the button is released.

14 Claims, 4 Drawing Sheets

EXTENDABLE SHOWER SEAT

BACKGROUND OF THE INVENTION

The present invention relates to shower seats. Specifically, the present invention relates to shower seats that can extend into a bench and provide a user with splash guards on opposing sides of the seat to prevent water from spraying outside of the shower area.

Many elderly and physically impaired individuals struggle to enter and exit a bath or remain standing for extended periods in a shower stall without assistance. Frequently, these individuals must rely on using a shower bench allowing a user to slide over the edge of a bathtub in a seated position, or remain seating in a shower stall. These conventional shower seats in the known art, however, are unable to prevent excess water from spilling out of the bathing area. Accumulation of excess water outside of the bathing area can lead to slip and fall accidents when the user exits the bath or shower stall. Additionally, mold and mildew can accumulate under the tile or flooring when exposed to standing water, leading to further health risks.

In light of the devices disclosed in the known art, it is submitted that the present invention substantially diverges in design elements from the known art and consequently it is clear that there is a need in the art for an improvement to existing extendable shower seats. In this regard, the instant invention substantially fulfills these needs.

SUMMARY OF THE INVENTION

In view of the foregoing disadvantages inherent in the known types of extendable shower seats now present in the prior art, the present invention provides an extendable shower seat wherein the same can be utilized for providing convenience for the user when entering and exiting a shower by extending the shower seat into a bench and preventing water from splashing outside of the shower area sing sidewalls that act as splash guards on opposing sides of the seat.

The present system comprises a chair having a back portion and a seat portion, wherein the back portion is perpendicularly affixed to a rear side of the seat portion. A frame is affixed to a lower side of the seat portion, wherein the frame includes a plurality of legs affixed thereto. A pair of sidewalls are pivotally affixed to opposing lateral sides of the seat portion about a hinge, such that the pair of sidewalls can selectively move about the hinge when a button disposed on the hinge is actuated. The pair of sidewalls are further configured to lock into the selected position when the button is released. In some embodiments, the frame further comprises a first end configured to move between an extended position and a retracted position, wherein the first end is aligned with one of the opposing lateral sides when the first end is in the retracted position, and wherein the linear distance between the first end and one of the opposing lateral sides is greater when the first end is in the extended position. In another embodiment, the frame further comprises a second end configured to move between an extended position and a retracted position, wherein the second end is aligned with one of the opposing lateral sides when the second end is in the retracted position, and wherein the linear distance between the second end and one of the opposing lateral sides is greater when the second end is in the extended position. In other embodiments, a handle is disposed on the first end. In yet another embodiment, the handle is pivotally affixed about the first end, wherein the handle is configured to selectively move about the first end.

In some embodiments, a plurality of apertures are disposed in the seat portion and the back portion, wherein the plurality of apertures are configured to allow water to pass therethrough. In another embodiment, the plurality of legs are adjustable in length via telescopic movement. In other embodiments, a foot is disposed on a distal end of each of the plurality of legs. In yet another embodiment, the foot comprises a material having a coefficient of friction greater than one. In some embodiments, the back portion is curved to conform to the back of a user.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
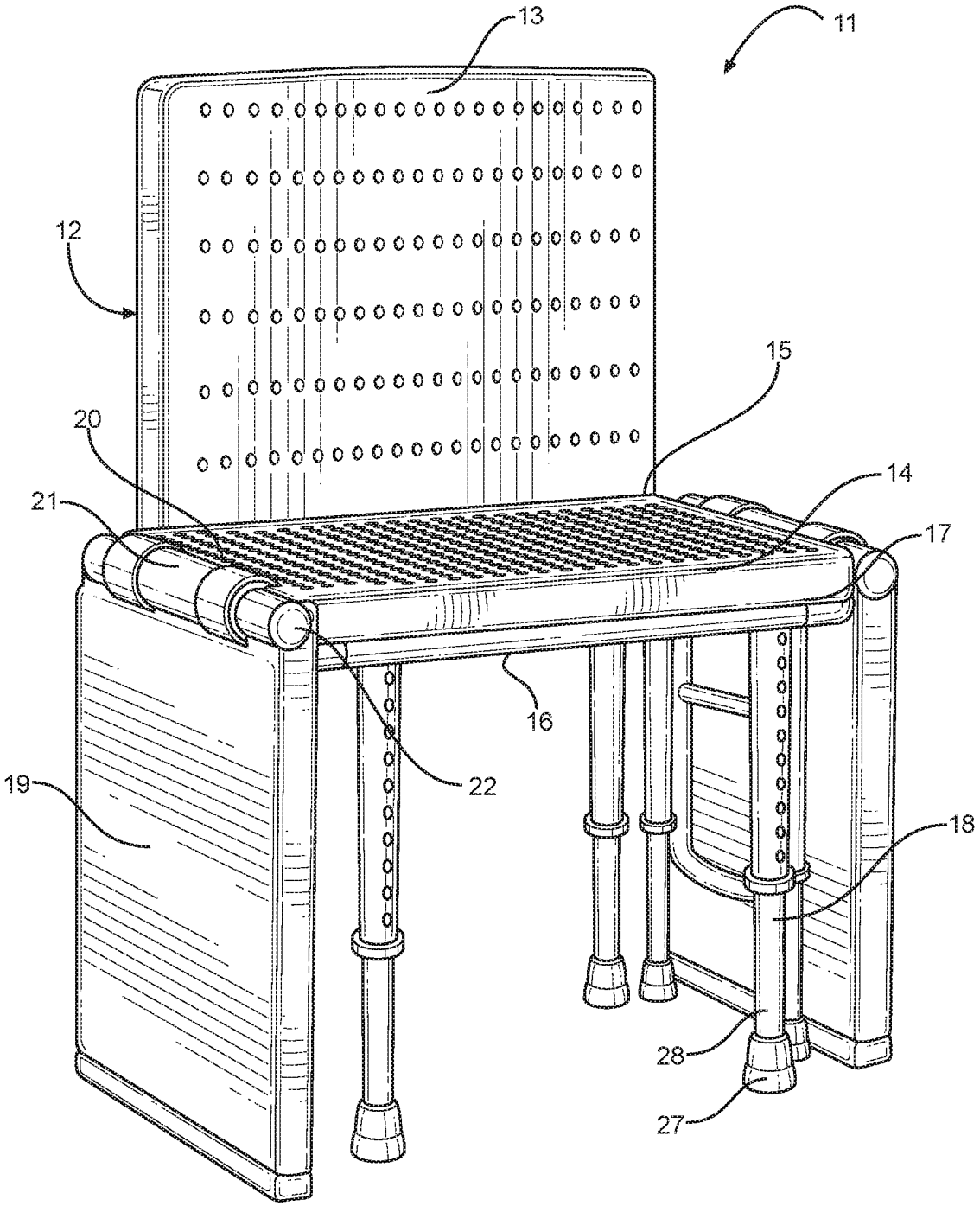
FIG. 1A shows a perspective view of an embodiment of the extendable shower seat with the pair of sidewalk in a lowered position.

Reference is made herein to the attached drawings. Like reference numerals are used throughout the drawings to depict like or similar elements of the extendable shower seat. The figures are intended for representative purposes only and should not be considered to be limiting in any respect.

Figure 1B:
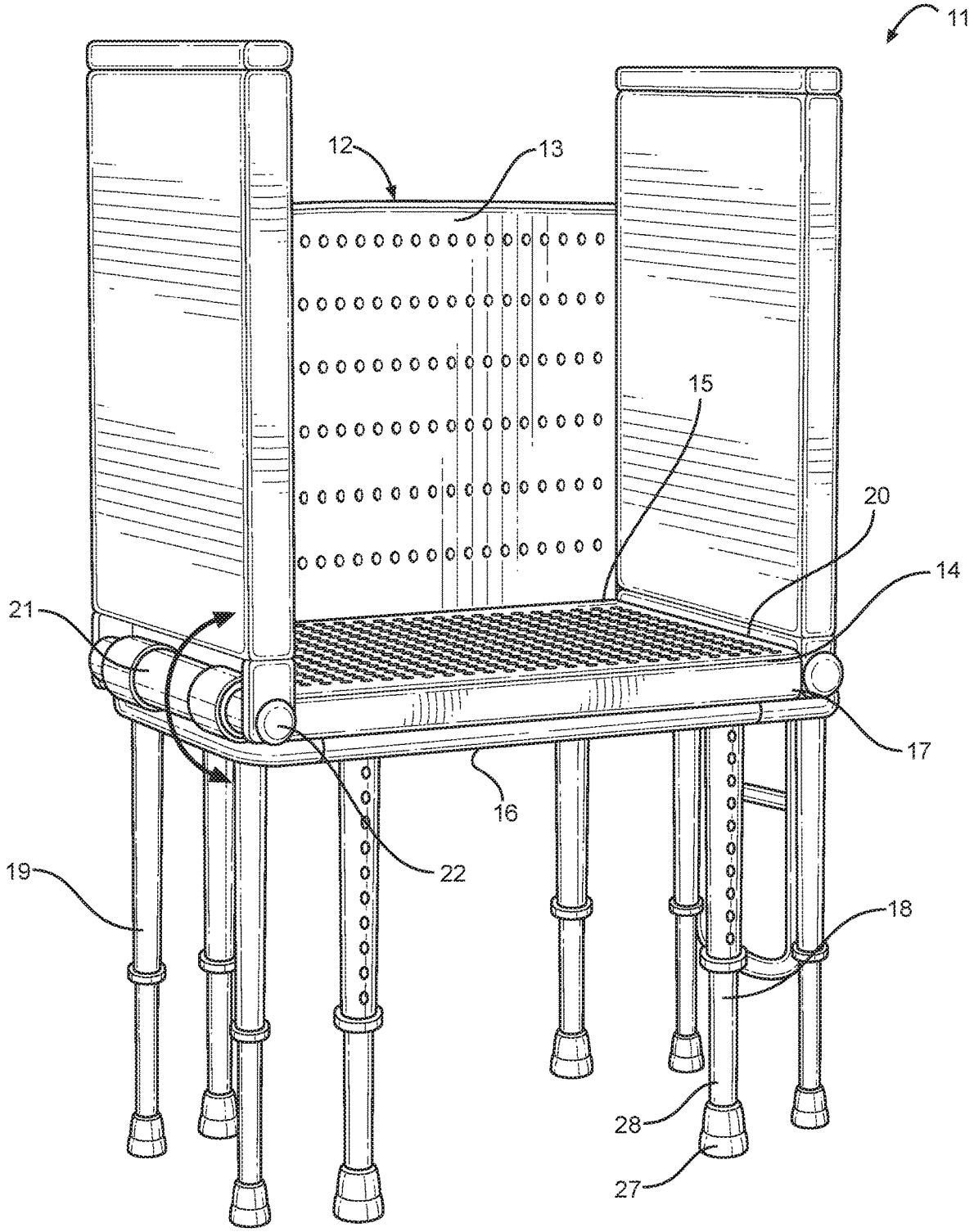
FIG. 1B shows a perspective view of an embodiment of the extendable shower seat with the pair of sidewalls in a raised position.

Referring now to FIGS. 1A and 1B, there is shown a perspective view of an embodiment of the extendable shower seat with the pair of sidewalls in a lowered position and a perspective view of an embodiment of the extendable shower seat with the pair of sidewalls in a raised position, respectively. In the illustrated embodiment, the extendable shower seat 11 comprises a chair 12 having a back portion 13 perpendicularly affixed to a seat portion 14 along a rear side 15 of the seat portion 14. In this way, the chair 12 can support the weight of a user on the seat portion 14 while providing back support via the back portion 13. In some embodiments, the back portion 13 is pivotally affixed to the seat portion 14 along the rear side 15 such that the user can adjust the position of the rear portion 13 as desired to maximize comfort. In the illustrated embodiment, the back portion 13 is curved such that the back portion 13 can conform to the back of a user, thereby increasing comfort.

In the illustrated embodiment, a frame 16 is disposed along a lower side 17 of the seat portion 14. The frame 16 is configured to provide support to the chair 12, distributing the weight thereon across a plurality of legs 18 extending from the frame 16. In the illustrated embodiment, the plurality of legs 18 extend away from the frame 16 such that the plurality of legs 18 are perpendicular to the seat portion 14. In some embodiments, the plurality of legs 18 are pivotally affixed to the frame 16 such that the plurality of legs 18 can be folded under the frame 16 to occupy less space for ease of storage. In the illustrated embodiment, the plurality of legs 18 are adjustable via a telescopic means, wherein the plurality of legs 18 can be selectively moved between a plurality of positions. In this way, the user can adjust the height of the chair 12 as desired to accommodate the height of the user. In the illustrated embodiment, the plurality of legs 18 further comprise a foot 27 disposed at a distal end 28 of each of the plurality of legs 18. The foot 27 is configured to increase stability of the extendable shower seat. In some embodiments, the foot 27 comprises a material having a coefficient of friction greater than one, such that the plurality of legs 18 can securely engage a surface in wet conditions, such as the base of a shower.

In the illustrated embodiment, a pair of sidewalls 19 are pivotally affixed to opposing lateral sides 20 of the seat portion 14 about a hinge 21. The pair of sidewalls 19 are configured to rotate about the hinge 21 in a 180-degree arc between a position perpendicular to the seat portion 14 below the hinge 21, and a position perpendicular to the seat portion 14 above the hinge 21 when a button 22 disposed on the hinge 21 is actuated. The hinge 21 is configured to lock the pair of sidewalls 19 in a current position when the button 22 is released. In this way, the user can set the pair of sidewalls 19 in the desired orientation relative to the chair 12 by freely rotating each of the pair of sidewalk 19 when the button 22 of each corresponding hinge 21 is actuated and releasing the button 22 when each of the pair of sidewalls 19 is in the desired position.

Figure 2:
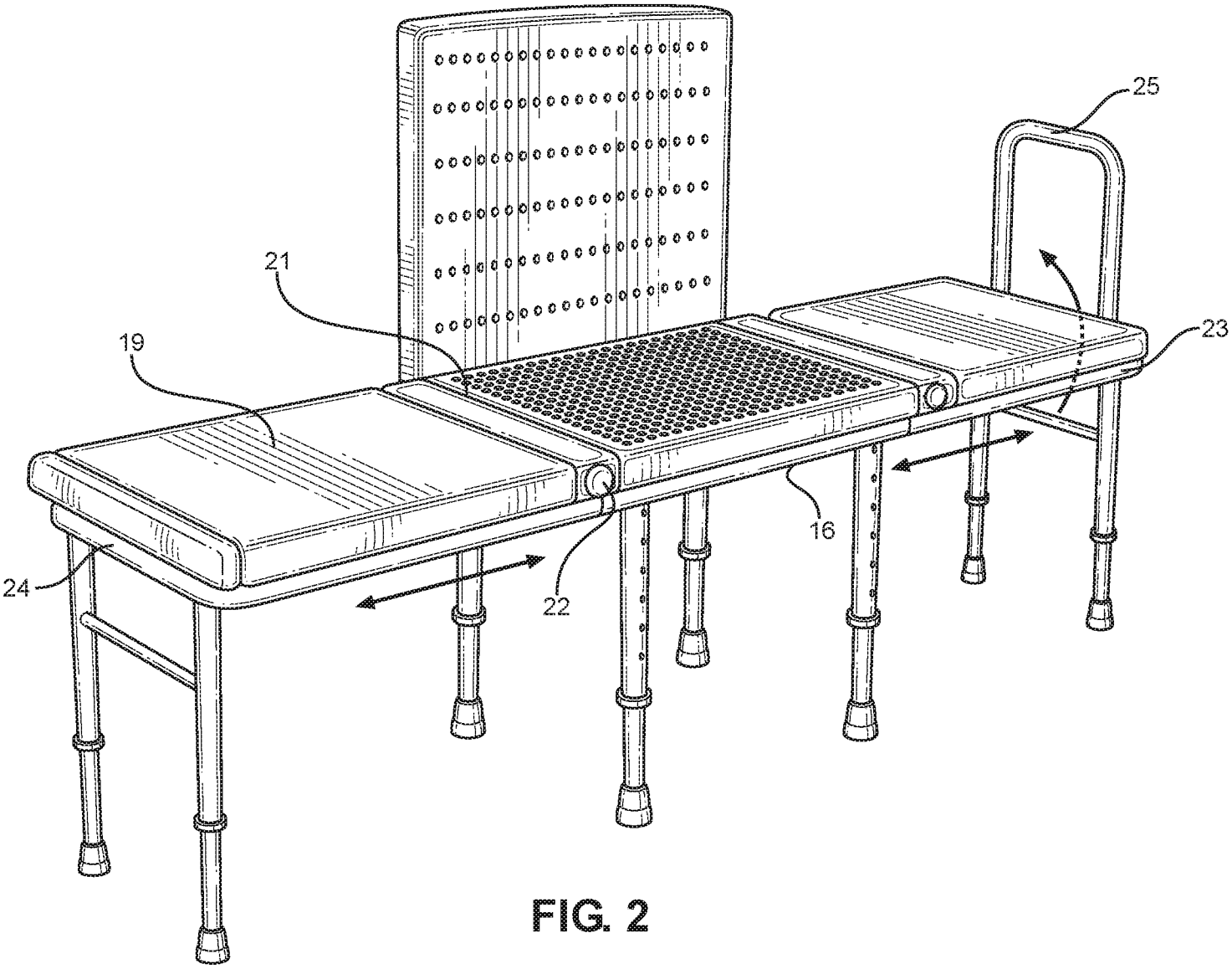
FIG. 2 shows a perspective view of an embodiment of the extendable shower seat with the frame in an extended position.

Referring now to FIG. 2, there is shown a perspective view of an embodiment of the extendable shower seat with the frame in an extended position. In the illustrated embodiment, the frame 16 further comprises a first end 23 and a second end 24, wherein the first and second ends 23, 24 are configured to selectively move between an extended position and a retracted position. In the extended position, a linear distance between each of the first and second ends 23, 24 and the hinge 21 is greater than when in the retracted position. In some embodiments, the first and second ends 23, 24 are aligned with the opposing lateral sides of the seat portion when in the retracted position, although in alternate embodiments, the first and second ends 23, 24 are aligned with each hinge 21. In this way, the frame 16 can act as a support for each of the pair of sidewalls 19 when the first and second ends 23, 24 are in the extended position, allowing a user to rest or otherwise place weight on the pair of sidewalls 19 without causing undue stress to the hinge 21. In the illustrated embodiment, additional legs having the same properties as the above described legs are affixed below each of the first and second ends 23, 24.

In the illustrated embodiment, the extendable shower seat is shown in a bench formation, allowing a user to easily climb or slide over the walls of a bathtub or shower stall. To aid the movement of a user, in some embodiments, the first end 23 further comprises a handle 25 pivotally affixed thereto. The handle 25 is configured to rotate about the first end 23 between a stored position and a deployed position, such that a user can grasp the handle 25 for additional support or to utilize as leverage in sliding across the extendable shower seat. In some embodiments, an additional handle 25 is pivotally affixed about the second end 24 such that the user can grasp a handle 25 when both entering and exiting a shower area. In the illustrated embodiment, the handle 25 comprises a U-shaped member, however other handle shapes such as rounded, square, or linear rods are contemplated.

Figure 3:
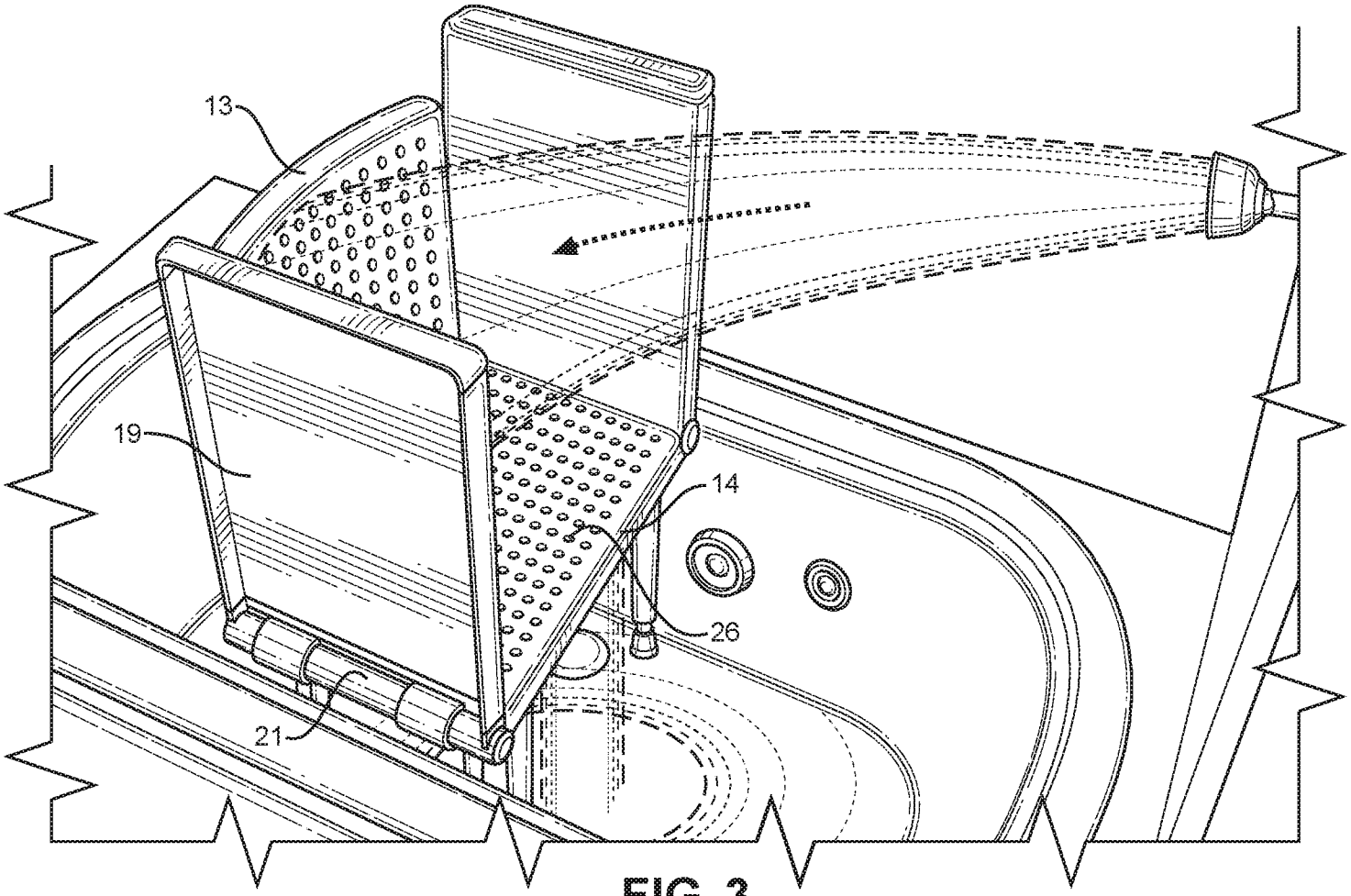
FIG. 3 shows a perspective view of an embodiment of the extendable shower seat in a shower area.

Referring now to FIG. 3, there is shown a perspective view of an embodiment of the extendable shower seat in a shower area. In the illustrated embodiment, the chair further comprises a plurality of apertures 26 are disposed on the seat portion 14 and the back portion 13 of the chair, thereby preventing water from accumulating thereon. In this way, a user can ensure a constant stream of fresh water, rather than sitting in accumulated run-off. In one exemplary use, the extendable shower seat is placed in a shower area such that the user can sit thereon. The pair of sidewalls 19 are placed in a position perpendicular to the seat portion 14 above the hinge 21, such that the pair of sidewalls 19 can function as a splash shield, thereby preventing water from exiting the shower area. In this way, the user can ensure that no water has accumulated outside of the shower area, thereby minimizing the danger of slipping upon exiting the shower area. The user then activates the shower and bathes themselves while seated, allowing the run-off water to escape through the plurality of apertures 26. When finished bathing, the user can lower one of the pair of sidewalls 19 and climb out of the shower area, or in an alternative embodiment, lower one of the pair of sidewalls 19 onto the extended frame and slide out of the shower area.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An extendable shower seat, comprising:

a chair having a back portion and a seat portion, wherein the back portion is perpendicularly affixed to a rear side of the seat portion;

a frame affixed to a lower side of the seat portion;

wherein a first end of the frame is slidably disposed within the frame, such that the first end is configured to move between an extended position and a retracted position via telescopic movement;

wherein the linear distance between the first end and a first side of opposing lateral sides of the seat portion is greater when in the extended position;

wherein the first side of the opposing lateral sides of the seat portion is adjacent to the first end of the frame when in the retracted position;

a plurality of legs affixed to the frame;

a pair of sidewalls, wherein each of the pair of sidewalls is pivotally affixed to the opposing lateral sides of the seat portion about a hinge; and a button disposed on the hinge, wherein the button is configured to selectively move the pair of sidewalls about the hinge when the button is actuated and lock the pair of sidewalls in the selected position when the button is released.

2. The extendable shower seat of claim 1, further comprising a second end of the frame, wherein the second end is slidably disposed within the frame, such that the second end is configured to move between an extended position and a retracted position via telescopic movement, and wherein the linear distance between the second end and a second side of the opposing lateral sides is greater when in the extended position.

3. The extendable shower seat of claim 2, wherein a pair of the plurality of legs are affixed to the second end of the frame, such that the second end is supported thereby when in the extended position.

4. The extendable shower seat of claim 1, further comprising a handle disposed on the first end.

5. The extendable shower seat of claim 4, wherein the handle is pivotally affixed to the first end and is configured to selectively move about the first end.

6. The extendable shower seat of claim 5, wherein the handle is disposed adjacent to the plurality of legs below the frame in a first position and is disposed adjacent to the plurality of legs above the frame in a second position.

7. The extendable shower seat of claim 1, further comprising a plurality of apertures disposed in the seat portion and the back portion, wherein the plurality of apertures are configured to allow water to pass therethrough.

8. The extendable shower seat of claim 1, wherein the plurality of legs are adjustable in length via telescopic movement.

9. The extendable shower seat of claim 1, wherein a foot is disposed on a distal end of each of the plurality of legs.

10. The extendable shower seat of claim 9, wherein the foot comprises a material having a coefficient of friction greater than one.

11. The extendable shower seat of claim 1, wherein the back portion is curved to conform to a user.

12. The extendable shower seat of claim 1, wherein a pair of the plurality of legs are affixed to the first end of the frame, such that the first end is supported thereby when in the extended position.

13. The extendable shower seat of claim 1, wherein a length of the pair of sidewalls is greater than a height of the back portion, such that the pair of sidewalls extend beyond the back portion when disposed perpendicularly above the seat portion.

14. An extendable shower seat, comprising:

a chair having a back portion and a seat portion, wherein the back portion is perpendicularly affixed to a rear side of the seat portion;

a frame affixed to a lower side of the seat portion;

wherein a first end of the frame is slidably disposed within the frame, such that the first end is configured to move between an extended position and a retracted position via telescopic movement;

wherein the linear distance between the first end and a first side of opposing lateral sides of the seat portion is greater when in the extended position;

wherein the first side of the opposing lateral sides of the seat portion is adjacent to the first end of the frame when in the retracted position;

a plurality of legs affixed to the frame;

a pair of sidewalls, wherein each of the pair of sidewalls is pivotally affixed to the opposing lateral sides of the seat portion about a hinge such that the pair of sidewalls are selectively movable between a raised position and a lowered position;

wherein a first sidewall of the pair of sidewalls rests upon the first end of the frame when the first end is in the extended position and the first sidewall is in the lowered position;

wherein the first sidewall is not in contact with the first end of the frame when in the raised position; and a button disposed on the hinge, wherein the button is configured to selectively move the pair of sidewalls about the hinge when the button is actuated and lock the pair of sidewalls in the selected position when the button is released.

* * * * *